US007595027B2

(12) United States Patent
Itoh

(10) Patent No.: US 7,595,027 B2
(45) Date of Patent: Sep. 29, 2009

(54) NOZZLE DEVICE FOR ALIQUOTING AND DISPENSING SPECIMEN INCORPORATED REFERENCE

(75) Inventor: Teruaki Itoh, Kumamoto (JP)

(73) Assignee: IDS Co., Ltd., Kumamoto (JP)

( * ) Notice: Subject to any disclaimer, the term of this patent is extended or adjusted under 35 U.S.C. 154(b) by 622 days.

(21) Appl. No.: 11/385,695

(22) Filed: Mar. 22, 2006

(65) Prior Publication Data

US 2007/0110630 A1 May 17, 2007

(30) Foreign Application Priority Data

Nov. 14, 2005 (JP) ..... 2005-328808

(51) Int. Cl.
*B01L 3/02* (2006.01)

(52) U.S. Cl. ..... 422/100; 422/103; 422/931; 73/863.32; 73/864; 73/864.01; 73/864.13

(58) Field of Classification Search ..... 422/100, 422/103; 73/863.32, 864, 864.01, 864.13
See application file for complete search history.

(56) References Cited

U.S. PATENT DOCUMENTS

| | | | | | |
|---|---|---|---|---|---|
| 3,919,085 | A * | 11/1975 | Ayres | 210/774 |
| 4,165,644 | A * | 8/1979 | Brandt et al. | 73/864.83 |
| 4,274,425 | A * | 6/1981 | Lutz et al. | 600/532 |
| 4,779,768 | A * | 10/1988 | St. Amand | 222/209 |
| 5,154,702 | A * | 10/1992 | Foyil | 604/212 |
| 5,423,287 | A * | 6/1995 | Usami et al. | 117/206 |
| 5,639,969 | A * | 6/1997 | D'Adamo | 73/818 |
| 5,741,464 | A * | 4/1998 | Giannone | 422/103 |
| 6,248,294 | B1 * | 6/2001 | Nason | 422/58 |
| 6,457,612 | B1 * | 10/2002 | Zhang et al. | 222/465.1 |
| 6,756,019 | B1 * | 6/2004 | Dubrow et al. | 422/102 |
| 6,846,680 | B2 * | 1/2005 | Friswell et al. | 436/180 |
| 7,033,543 | B1 * | 4/2006 | Panzer et al. | 422/100 |
| 7,115,234 | B2 * | 10/2006 | Freitag et al. | 422/130 |
| 7,378,058 | B2 * | 5/2008 | Lemme et al. | 422/100 |
| 2005/0042765 | A1 * | 2/2005 | Hubner et al. | 436/169 |
| 2007/0025880 | A1 * | 2/2007 | Hoummady | 422/100 |
| 2008/0138249 | A1 * | 6/2008 | Itoh | 422/100 |

FOREIGN PATENT DOCUMENTS

| | | |
|---|---|---|
| JP | 48-27490 | 8/1973 |
| JP | 6-323964 | 11/1994 |
| JP | 9-127130 | 5/1997 |
| JP | 2002-542017 | 12/2002 |

* cited by examiner

*Primary Examiner*—Brian R. Gordon
(74) *Attorney, Agent, or Firm*—Nixon & Vanderhye P.C.

(57) ABSTRACT

A nozzle device, comprising a nozzle body, a ball provided in the nozzle body and elastically deformable by compression, an aliquoting/dispensing tip having a barrel portion in which the nozzle body including the ball is inserted, and a ball compressing mechanism which is provided in the nozzle body, configured elastically to deform the ball by compression so that the diameter of the ball increases with the nozzle body including the ball inserted in the barrel portion of the aliquoting/dispensing tip, thereby pressing the ball airtightly against an inner peripheral surface of the barrel portion of the tip, when the tip is attached to the nozzle body, and configured to remove a compressive force from the ball so that the diameter of the ball is reduced, thereby separating the ball from the inner peripheral surface of the barrel portion of the tip, when the tip is detached from the nozzle body.

3 Claims, 3 Drawing Sheets

NOZZLE DEVICE FOR ALIQUOTING AND DISPENSING SPECIMEN INCORPORATED REFERENCE

CROSS-REFERENCE TO RELATED APPLICATIONS

This application is based upon and claims the benefit of priority from prior Japanese Patent Application No. 2005-328808, filed Nov. 14, 2005, the entire contents of which are incorporated herein by reference.

BACKGROUND OF THE INVENTION

1. Field of the Invention

This invention relates to a nozzle device for aliquoting a specimen from a test tube or some other specimen container that contains a specimen, such as blood, and dispensing the specimen into another specimen container.

2. Description of the Related Art

In a known nozzle device for aliquoting and dispensing a specimen such as blood, as is described in Jpn. Pat. Appln. KOKAI Publication No. 6-323964, for example, a nozzle portion and a dispensing tip are attached to and detached from each other with use of a balloon that can be inflated and deflated by supplying and discharging a fluid. In this aliquoting/dispensing device, a balloon is provided on the nozzle portion of a head member that is located on the distal end of a specimen supply/discharge pipe. This balloon is connected to a fluid supply/discharge pipe and configured to be inflated or deflated as the fluid is supplied or discharged. If the fluid is supplied to the balloon through the fluid supply/discharge pipe with the nozzle portion including the balloon inserted in a barrel portion at the proximal end portion of the dispensing tip, the balloon is inflated and brought intimately into contact with the inner peripheral surface of the barrel portion of the tip. If the fluid in the balloon is discharged through the fluid supply/discharge pipe, on the other hand, the balloon is deflated and separated from the inner peripheral surface of the barrel portion of the tip. Thus, the nozzle portion and the dispensing tip can be attached to and detached from each other.

In another known nozzle device, as is described in Jpn. Pat. Appln. KOKAI Publication No. 9-127130, for example, a nozzle portion and a dispensing tip are attached to and detached from each other with use of an elastic bag capable of inflation and deflation. In this nozzle device, a ring-shaped elastic bag is provided on the outer periphery of the distal end portion of a nozzle body. This elastic bag has a hollow portion through which a fluid can be supplied and discharged. If the fluid is supplied to the bag through a fluid supply/discharge pipe with the nozzle body including the bag inserted in a barrel portion at the proximal end portion of the dispensing tip, the bag is inflated and brought intimately into contact with the inner peripheral surface of the barrel portion of the tip. If the fluid in the bag is discharged through the fluid supply/discharge pipe, on the other hand, the bag is deflated and separated from the inner peripheral surface of the barrel portion of the tip. Thus, the nozzle portion and the dispensing tip can be attached to and detached from each other.

In either of the prior art examples described above, however, the balloon is inflated or deflated by supplying or discharging the fluid so that it is pressed against or separated from the inner peripheral surface of the barrel portion of the dispensing tip, whereby the nozzle portion and the tip are attached to or detached from each other. Since an additional device is needed to supply and discharge the fluid to and from the balloon, therefore, the construction of the nozzle device is complicated. While the balloon, which should be inflated and deflated, must be thin-walled, moreover, it is easily damaged by friction as it is rubbed against the inner peripheral surface of the barrel portion of the dispensing tip. Thus, the balloon requires frequent maintenance including replacement.

BRIEF SUMMARY OF THE INVENTION

An aspect of the invention is; a nozzle device comprising: a nozzle body having a nozzle portion on a distal end portion of an aliquoting/dispensing pipe through which a specimen is aliquoted and dispensed; a ball provided in the nozzle body and elastically deformable by compression; an aliquoting/dispensing tip having a barrel portion in which the nozzle body including the ball is inserted; and a ball compressing mechanism which is provided in the nozzle body, configured elastically to deform the ball by compression so that the diameter of the ball increases with the nozzle body including the ball inserted in the barrel portion of the aliquoting/dispensing tip, thereby pressing the ball airtightly against an inner peripheral surface of the barrel portion of the tip, when the tip is attached to the nozzle body, and configured to remove a compressive force from the ball so that the diameter of the ball is reduced, thereby separating the ball from the inner peripheral surface of the tip, when the tip is detached from the nozzle body. Wherein a pair of the balls are located spaced in the axial direction of the nozzle body and are configured to be simultaneously compressed and pressed airtightly against the inner peripheral surface of the barrel portion of the aliquoting/dispensing tip. Wherein the ball is interposed between flange portions on the nozzle body and is compressed as the flange portions approach each other. Wherein the ball compressing mechanism comprises a fluid cylinder, a plunger which is advanced and retreated in the axial direction of the nozzle body by the cylinder, and flange portions which are coupled to the plunger and compress or release the ball as the plunger is advanced or retreated by the fluid cylinder.

According to the nozzle device of the present invention, the nozzle body and the dispensing tip can be attached and detached by elastically deforming the deformable balls, so that the construction of the device can be simplified.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of this invention will now be described with reference to the accompanying drawings.

Figure 1A:
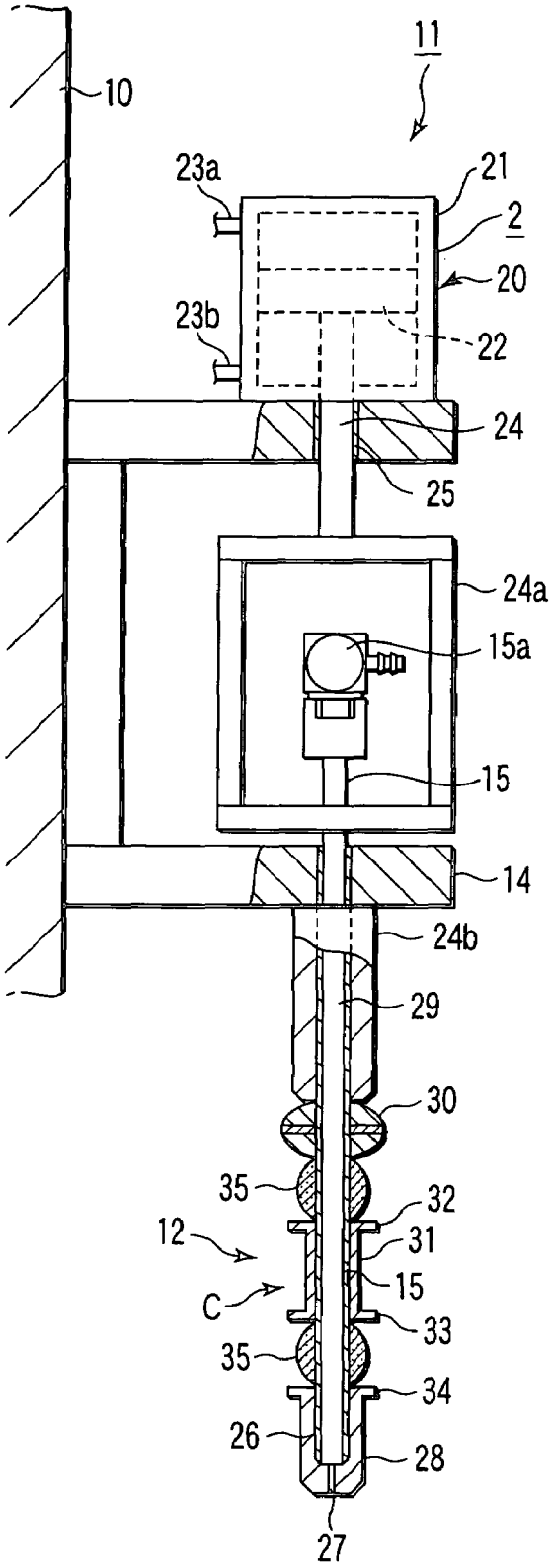
FIG. 1A is a longitudinal side sectional view of a nozzle device according to a first embodiment of the invention with its balls released from compressive force.
Figure 1B:
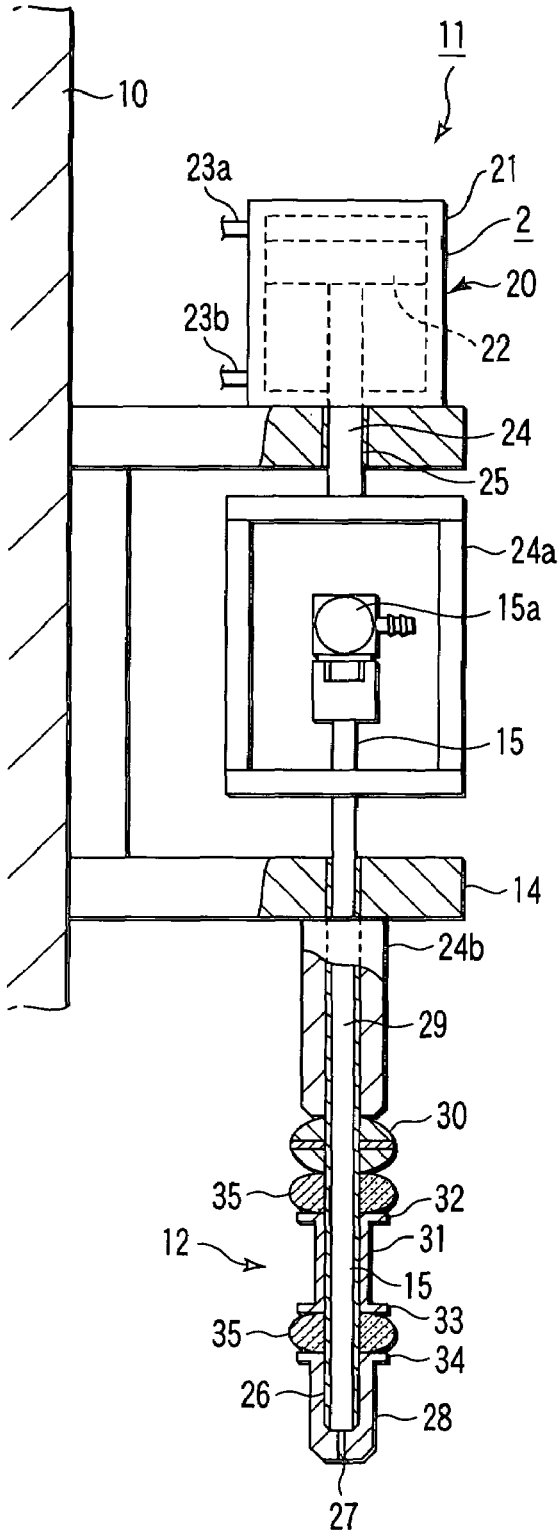
FIG. 1B is a longitudinal side sectional view of the nozzle device with its balls compressed.
Figure 2:
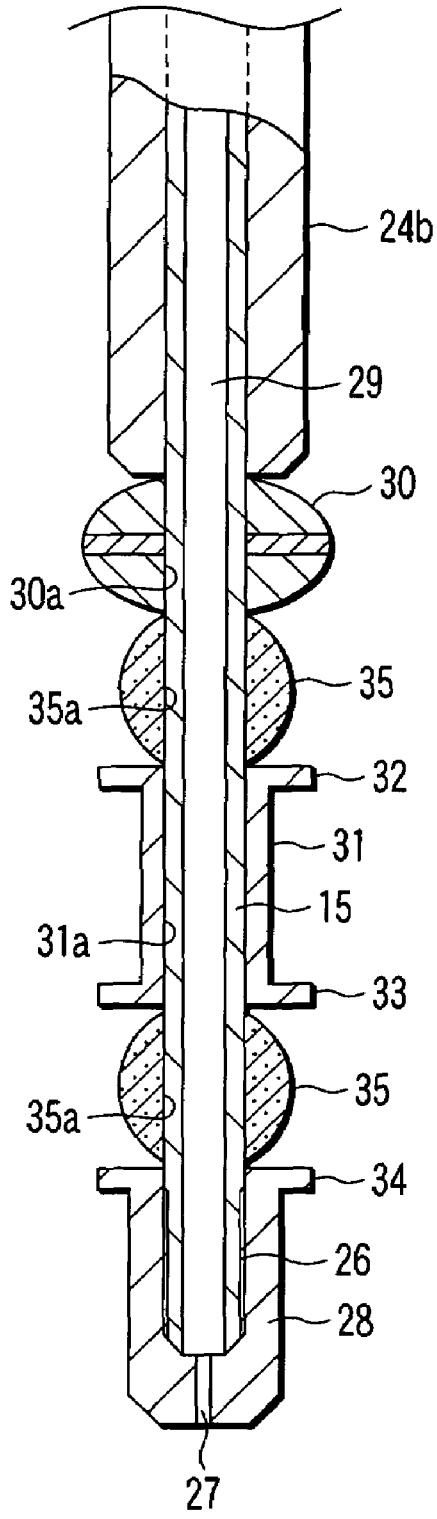
FIG. 2 is an enlarged longitudinal side sectional view showing a section C of FIG. 1A.
Figure 3:
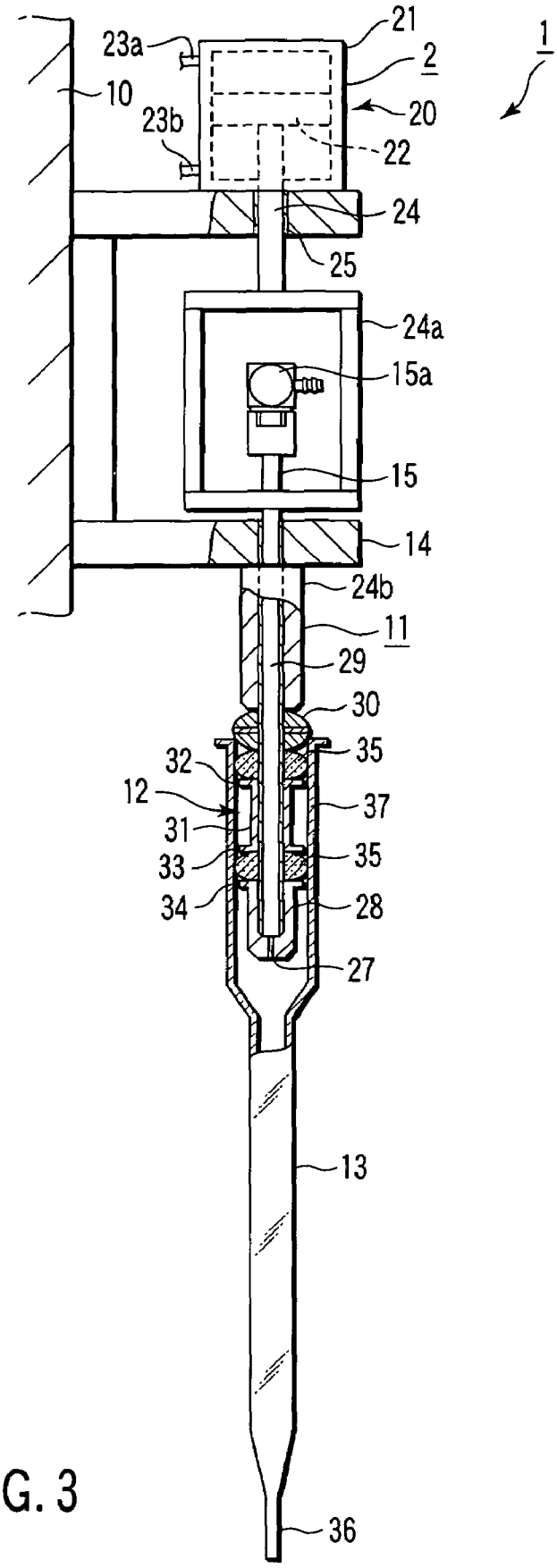
FIG. 3 is a longitudinal side sectional view of the nozzle device with an aliquoting/dispensing tip attached to its nozzle body.

FIGS. 1 to 3 show a first embodiment of the invention. FIG. 1A is a longitudinal side sectional view of a nozzle device with its balls released from compressive force. FIG. 1B is a longitudinal side sectional view of the nozzle device with its balls compressed. FIG. 2 is an enlarged longitudinal side sectional view showing a section C of FIG. 1A. FIG. 3 is a longitudinal side sectional view of the nozzle device with an aliquoting/dispensing tip attached to its nozzle body. The aliquoting/dispensing tip is shown in neither of FIGS. 1A, 1B and 2.

As shown in FIG. 3, a nozzle device 1 for aliquoting and dispensing a specimen such as blood comprises a nozzle mechanism section 11, which is supported by an ascending/descending mechanism 10 for ascent and descent in the vertical direction, and an aliquoting/dispensing tip 13 vertically supported on a rack or the like.

The nozzle mechanism section 11 will be described first. A support member 14 supported on the ascending/descending mechanism 10 is provided with an aliquoting/dispensing pipe 15 that is movable in the vertical direction. A proximal end portion 15a of the pipe 15 is connected to a suction/discharge device (not shown) for aliquoting and dispensing a specimen such as blood through piping or the like. A nozzle body 12 is provided on the distal end portion of the aliquoting/dispensing pipe 15.

As shown in FIGS. 1 and 2, the support member 14 is provided with a vertical air cylinder 20 for use as a fluid cylinder that constitutes a ball compressing mechanism 2. A piston 22 that is fixed to the aliquoting/dispensing pipe 15 is inserted in a cylinder section 21 of the air cylinder 20. Air supply/discharge pipes 23*a* and 23*b* are connected to upper and lower chambers, respectively, of the cylinder section 21. The piston 22 is moved up or down by air that is supplied or discharged through the pipes 23*a* and 23*b*. The piston 22 is coupled with a plunger 24 formed of a pipe that is connected directly to the aliquoting/dispensing pipe 15. The plunger 24 projects downward through a guide member 25 that is attached to the support member 14.

A connecting frame 24*a* is fixed to the lower end portion of the plunger 24. The proximal end portion 15*a* of the aliquoting/dispensing pipe 15 is coupled and fixed to the frame 24*a*. Thus, the connecting frame 24*a* and the pipe 15 can be moved up and down by the air cylinder 20. The pipe 15 that projects downward from the connecting frame 24*a* is passed for up-and-down motion through a guide pipe 24*b* that is fixed to the support member 14. The nozzle body 12 is provided on the lower end portion of the aliquoting/dispensing pipe 15. More specifically, a screw portion 26 is provided on the distal end portion of the pipe 15, and a nozzle portion 28 is fixed to the screw portion 26. A nozzle orifice 27 is formed in the distal end of the nozzle portion 28. The orifice 27 communicates with the suction/discharge device (not shown) for aliquoting and dispensing a specimen such as blood by means of a passage 29 of the aliquoting/dispensing pipe 15.

Further, a fixed flange portion 30 having an arcuate profile is provided as a stopper on the lower end portion of the guide pipe 24*b*. The flange portion 30 has a through hole 30*a* through which the aliquoting/dispensing pipe 15 can move in the axial direction. Furthermore, a cylindrical moving tube 31 is provided under the flange portion 30. The moving tube 31 has a through hole 31*a* through which the aliquoting/dispensing pipe 15 can move in the axial direction. Movable flange portions 32 and 33 are formed integrally on the upper and lower end portions of the moving tube 31. The upper movable flange portion 32 on the tube 31 is opposed to the fixed flange portion 30 at a distance from it. The lower movable flange portion 33 is opposed to a fixed flange portion 34, which is integral with the nozzle portion 28, at a distance from it. Thus, gaps are defined individually between the fixed flange portion 30 and the movable flange portion 32 and between the fixed flange portion 34 and the movable flange portion 33. Silicone balls 35 for use as elastically deformable balls are fitted individually in these gaps. Each silicone ball 35 is a solid sphere having a through hole 35*a* through which the aliquoting/dispensing pipe 15 can move in the axial direction. When the balls 35 are compressed in the vertical direction, they are elastically deformed so that their diameters are larger than the outside diameters of the flange portions 32, 33 and 34. Thus, the balls 35 are flattened in the direction of compression and deformed so that their outside diameters in planes perpendicular to the compression direction increase. If the compressive force is removed, the silicone balls 35 are restored to their original shape such that their outside diameters in the planes perpendicular to the compression direction are smaller than those of the flange portions 32, 33 and 34.

As shown in FIG. 3, the aliquoting/dispensing tip 13 is a hollow cylinder of transparent plastic or glass. A taper portion 36 and a barrel portion 37 are provided on the distal and proximal end portions, respectively, of the tip 13. The inside diameter of the barrel portion 37 is larger than each of the respective outside diameters of the movable flange portions 32 and 33, fixed flange portion 34, and silicone balls 35 so that the flange portions 32, 33 and 34 and the balls 35, along with the nozzle portion 28, can be inserted into the barrel portion 37.

The following is a description of the operation of the nozzle device 1.

If the piston 22 of the air cylinder 20 is in a neutral state, as shown in FIG. 1A, the plunger 24 and the aliquoting/dispensing pipe 15 project downward. In this state, no pressure acts on the silicone balls 35 between the fixed flange portion 30 and the movable flange portion 32 and between the fixed flange portion 34 and the movable flange portion 33. Therefore, the balls 35 are nearly perfectly spherical. In this state, the entire nozzle mechanism section 11 is moved by the ascending/descending mechanism 10. The nozzle body 12 is positioned over the aliquoting/dispensing tip 13. Then, the entire nozzle mechanism section 11 descends, whereupon the nozzle body 12 is inserted into the barrel portion 37 of the tip 13. Thus, the movable flange portions 32 and 33, fixed flange portion 34, and silicone balls 35, along with the nozzle portion 28, are inserted into the barrel portion 37.

If air is fed through the air supply/discharge pipe 23*b* into the lower chamber of the cylinder section 21 and discharged through the air supply/discharge pipe 23*a* in this state, the piston 22 ascends in the cylinder section 21. As this is done, the plunger 24 that is integral with the piston 22 ascends.

As the plunger 24 ascends in this manner, the aliquoting/dispensing pipe 15 ascends through the connecting frame 24*a* on the distal end portion of the plunger 24, and the nozzle portion 28 also ascends. Thereupon, the gap between the fixed flange portions 30 and 34 narrows. As this is done, the fixed flange portion 30 and the movable flange portion 32 approach each other, and the fixed flange portion 34 and the movable flange portion 33 approach each other. Thereupon, as shown in FIG. 1B, the silicone balls 35 are vertically compressed to be elastically deformed so that their outside diameters in a plane perpendicular to the compressing direction are larger than those of the movable flange portions 32 and 33 and the fixed flange portion 34.

If the silicone balls 35 are elastically deformed and increased in diameter, they come intimately into contact with the inner peripheral surface of the barrel portion 37 of the aliquoting/dispensing tip 13, as shown in FIG. 3. Thereupon, the nozzle body 12 and the tip 13 are connected airtightly.

Then, the nozzle body 12 and the aliquoting/dispensing tip 13 are moved in an integrated manner by the ascending/descending mechanism 10 and inserted into a test tube (not shown). If suction is performed by the suction/discharge device in this state, the pressure in the tip 13 is made negative by the aliquoting/dispensing pipe 15, so that a serum in the test tube is aliquoted into the tip 13.

If the ascending/descending mechanism 10 moves again so that the nozzle body 12 and the aliquoting/dispensing tip 13 ascend in an integrated manner, the tip 13 gets out of the test tube. Then, the nozzle body 12 and the tip 13 that contain the aliquoted serum are positioned in another test tube or the like. If discharge is performed by the suction/discharge device in this state, the pressure in the tip 13 is made positive by the aliquoting/dispensing pipe 15, so that the serum in the tip 13 is dispensed into test tubes or the like.

After the aliquoting and dispensing operation is finished, air is fed through the air supply/discharge pipe 23*a* into the upper chamber of the cylinder section 21 and discharged through the air supply/discharge pipe 23*b*. Thereupon, the piston 22 descends in the cylinder section 21. As this is done, the plunger 24 that is integral with the piston 22 descends.

If the nozzle portion 28 on the distal end portion of the aliquoting/dispensing pipe 15 descends as the plunger 24 descends, the gap between the fixed flange portions 30 and 34 widens. In other words, the fixed flange portions 30 and 34 move away from the movable flange portions 32 and 33, respectively. As this is done, the compressive force of the silicone balls 35 that are interposed between the flange portions 30 and 32 and between the flange portions 34 and 33 is removed. Thereupon, the balls 35 are reduced in diameter. Thus, the balls 35 are restored to their original shape such that their outside diameters in the planes perpendicular to the axial direction or the compression direction are smaller than those of the flange portions 32, 33 and 34.

If the silicone balls 35 are reduced in diameter, they are separated from the inner peripheral surface of the barrel portion 37 of the aliquoting/dispensing tip 13. Thus, the nozzle body 12 and the aliquoting/dispensing tip 13 are disconnected and separated from each other.

According to the nozzle device 1 of the present embodiment, the nozzle body and the dispensing tip can be attached and detached by elastically deforming the deformable balls, so that the construction of the device can be simplified. Unlike a balloon that should be inflated and deflated, the balls need not be reduced in wall thickness, so that their reliability can be ensured. Thus, the labor of maintenance can be reduced.

The present invention is not limited to the embodiment described above, and its components may be embodied in modified forms without departing from the scope or spirit of the invention. In the foregoing embodiment, for example, the ball compressing mechanism 2 is constructed so that the silicone balls are compressed and released by vertically moving the plunger by means of the fluid cylinder or the like. However, the fluid cylinder may be replaced with an actuator, such as a motor-driven rack-and-pinion mechanism or a solenoid. Although the two silicone balls 35 are used in the foregoing embodiment, they may be replaced with plastic balls, and their number is not limited to two.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A nozzle device comprising:

a nozzle body having a nozzle portion on a distal end portion of an aliquoting/dispensing pipe through which a specimen is aliquoted and dispensed;

at least one pair of solid sphere silicone balls, each having a through hole through which the nozzle body moves in an axial direction and cooperable with the nozzle body and elastically deformable by compression so that their outside diameters in a plane perpendicular to a direction of compression are larger than the outside diameters of the nozzle body when the solid sphere silicone balls are compressed in the axial direction of the nozzle body;

an aliquoting/dispensing tip having a barrel portion in which the nozzle body cooperable with the silicone balls is inserted; and a ball compressing mechanism which is cooperable with the nozzle body, configured elastically to deform the silicone balls by compression so that the outside diameter of the silicone balls in the plane perpendicular to the direction of compression increases, thereby pressing the silicone balls airtightly against an inner peripheral surface of the barrel portion of the tip, when the tip is attached to the nozzle body, and configured to remove a compressive force from the silicone balls so that the outside diameter of the silicone balls is reduced, thereby separating the silicone balls from the inner peripheral surface of the barrel portion of the tip, when the tip is detached from the nozzle body, wherein the silicone balls are located spaced in the axial direction of the nozzle body, a cylindrical moving tube having upper and lower movable flange portions movable in the axial direction of the nozzle body is fitted between the silicone balls, and fixed flange portions at the nozzle body respectively opposing the movable flange portions with the silicone balls interposed therebetween; and wherein when the nozzle body moves in the axial direction, the movable flange portions move closer to the fixed flange portions, so that the silicone balls are simultaneously compressed and airtightly pressed against the inner peripheral surface of the barrel portion of the aliquoting/dispensing tip.

2. The nozzle device according to claim 1, wherein the ball compressing mechanism comprises a fluid cylinder, a plunger which is moved up and down by the cylinder, and a nozzle body having a nozzle portion on a lower end portion which is coupled to the plunger and moves up and down, wherein the movement of the nozzle body by the fluid cylinder compresses or releases the silicone balls between the fixed flange portions and the movable flange portions.

3. The nozzle device according to claim 1, wherein the solid sphere silicone balls are respectively interposed between the fixed flange portions and the movable flange portions; and when the silicone balls are compressed as the nozzle body moves in the axial direction and the movable flange portions move closer to the fixed flange portions, the outside diameters of the silicone balls become larger than outside diameters of the fixed flange portions and the movable flange portions by compressive force, and when the compressive force is removed, the outside diameters of the silicone balls become smaller than outside diameters of the fixed flange portions and the movable flange portions.

* * * * *